US011744329B2

(12) United States Patent
Ha

(10) Patent No.: US 11,744,329 B2
(45) Date of Patent: Sep. 5, 2023

(54) WIRE TIGHTENING DEVICE

(71) Applicants: SPINON CO., LTD, Busan (KR); Young Ho Ha, Busan (KR)

(72) Inventor: Young Ho Ha, Busan (KR)

(73) Assignees: SPINON CO., LTD, Busan (KR); Young Ho Ha, Busan (KR)

( * ) Notice: Subject to any disclaimer, the term of this patent is extended or adjusted under 35 U.S.C. 154(b) by 0 days.

(21) Appl. No.: 17/927,100

(22) PCT Filed: Jun. 8, 2021

(86) PCT No.: PCT/KR2021/007138
§ 371 (c)(1),
(2) Date: Nov. 22, 2022

(87) PCT Pub. No.: WO2022/014866
PCT Pub. Date: Jan. 20, 2022

(65) Prior Publication Data

US 2023/0189934 A1 Jun. 22, 2023

(30) Foreign Application Priority Data

Jul. 14, 2020 (KR) ..... 10-2020-0087038

(51) Int. Cl.
*A43C 11/16* (2006.01)
*A43C 11/14* (2006.01)

(52) U.S. Cl.
CPC ..... *A43C 11/165* (2013.01); *A43C 11/146* (2013.01)

(58) Field of Classification Search
CPC ..... A43C 11/165; A43C 11/146; A43C 11/14; B65H 75/4452; Y10T 24/2183; Y10T 24/3724
See application file for complete search history.

(56) References Cited

U.S. PATENT DOCUMENTS 8,353,087 B2 * 1/2013 Chen ..... A43C 11/165 24/68 SK
9,101,181 B2 * 8/2015 Soderberg ..... A43C 11/165
(Continued)

FOREIGN PATENT DOCUMENTS

JP 3202821 2/2016
KR 10-1053551 8/2011
(Continued)

OTHER PUBLICATIONS

KIPO, Office Action of KR 10-2020-0087038 dated Aug. 25, 2020.
JPO, Office Action of JP 2021-110469 dated Jul. 5, 2021.
KIPO, PCT Search Report of PCT/KR2021/007138 dated Sep. 2, 2021.

*Primary Examiner* — Robert Sandy
*Assistant Examiner* — Rowland Do
(74) *Attorney, Agent, or Firm* — LEX IP MEISTER, PLLC

(57) ABSTRACT

The present invention provides a wire tightening device which is installed in shoes or the like and structured so that a tightening operation for tightening a wire can be performed with ease, and the position of a part winding the wire is lifted inside a housing. The present invention comprises: a winding wheel which is positioned in the inner space of the housing and has a vertical through hole formed in the center; and an ascending/descending member that is positioned in the through hole of the winding wheel and coupled to the winding wheel through ratchet coupling, and is provided with engagement teeth which are formed in the lower portion and interlock with locking teeth of the housing.

8 Claims, 12 Drawing Sheets

(56) References Cited

U.S. PATENT DOCUMENTS

| | | | | |
|---|---|---|---|---|
| 9,486,039 | B2 * | 11/2016 | Ha | A42B 1/22 |
| 9,706,814 | B2 * | 7/2017 | Converse | A61F 5/0123 |
| 10,477,924 | B2 * | 11/2019 | Midorikawa | A43C 11/165 |
| 10,842,230 | B2 * | 11/2020 | Pollack | A43C 11/20 |
| 10,993,504 | B1 * | 5/2021 | Li | A43C 11/165 |
| 2005/0247813 | A1 * | 11/2005 | Kovacevich | A42B 3/08 242/395 |
| 2013/0025100 | A1 * | 1/2013 | Ha | A43C 11/165 24/712.9 |
| 2015/0076272 | A1 * | 3/2015 | Trudel | A43C 11/165 242/381.4 |
| 2016/0120267 | A1 * | 5/2016 | Burns | A44B 11/065 24/68 C |
| 2017/0325548 | A1 * | 11/2017 | Ha | A43C 11/165 |
| 2020/0128918 | A1 * | 4/2020 | Chen | A43C 7/08 |
| 2021/0127794 | A1 * | 5/2021 | Chen | A43C 11/06 |
| 2021/0127795 | A1 * | 5/2021 | Chen | A43C 11/08 |
| 2021/0186160 | A1 * | 6/2021 | Chen | B65H 75/4434 |
| 2022/0142304 | A1 * | 5/2022 | Chen | B65H 75/4494 |
| 2022/0386742 | A1 * | 12/2022 | Büttner | A43C 11/165 |
| 2023/0056011 | A1 * | 2/2023 | Chen | A43C 11/16 |

FOREIGN PATENT DOCUMENTS

| | | |
|---|---|---|
| KR | 10-1648816 | 8/2016 |
| KR | 10-1763868 | 8/2017 |
| KR | 10-1804801 | 12/2017 |
| KR | 10-1880805 | 8/2018 |
| KR | 10-2020-0028846 | 3/2020 |

* cited by examiner

[FIG 1] -- Prior Art --
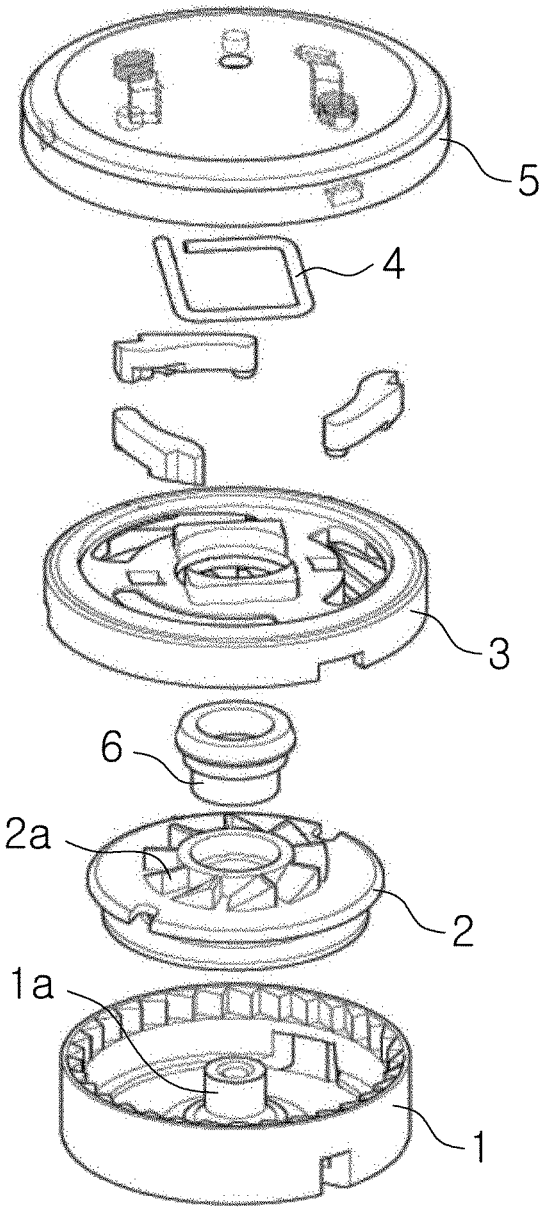

[FIG 2(a)] -- Prior Art --
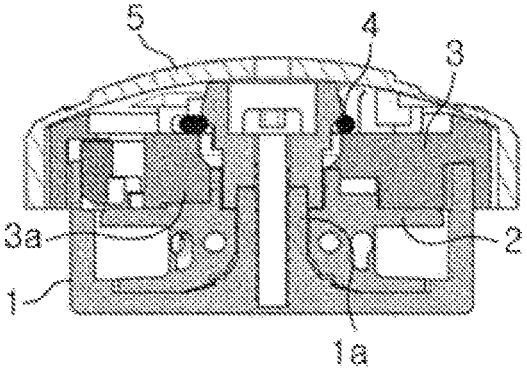
[FIG 2(b)] -- Prior Art --
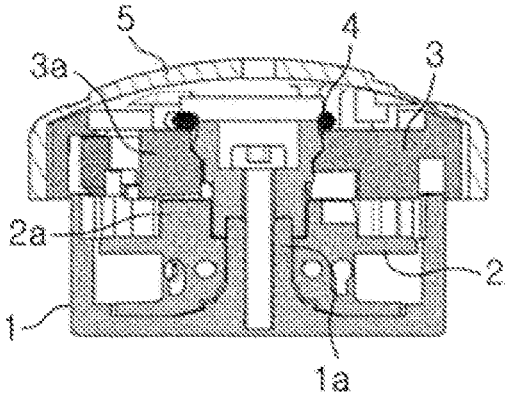

[FIG 3]
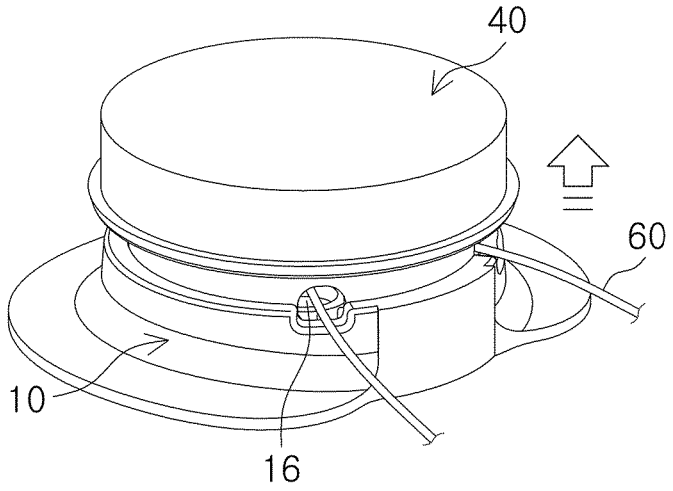

[FIG 4]
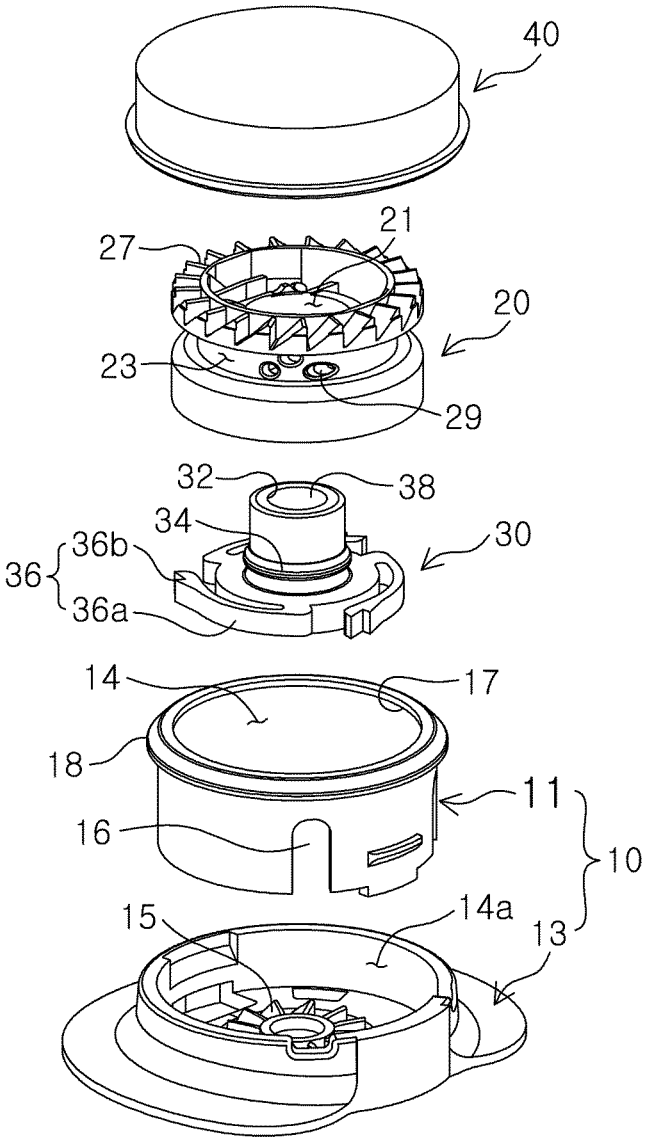

[FIG 5]
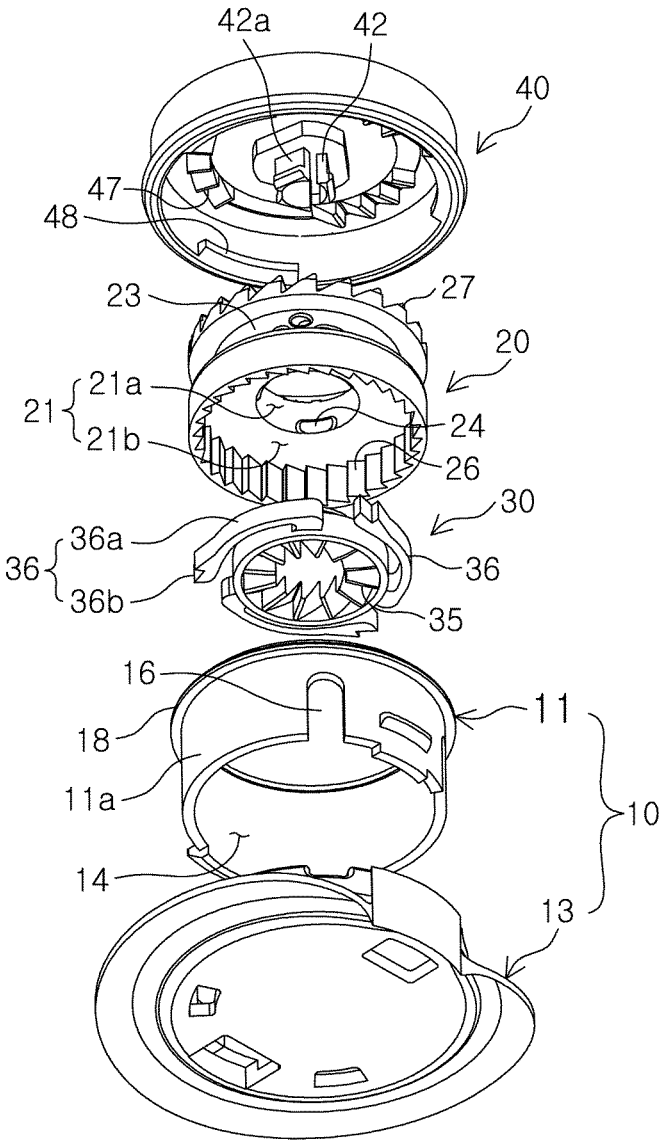

[FIG 6]
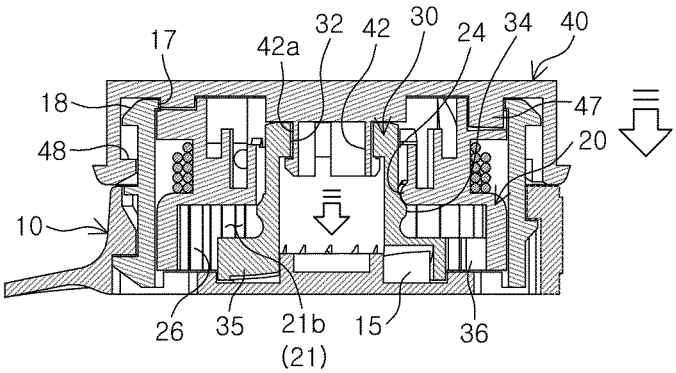
[FIG 7]
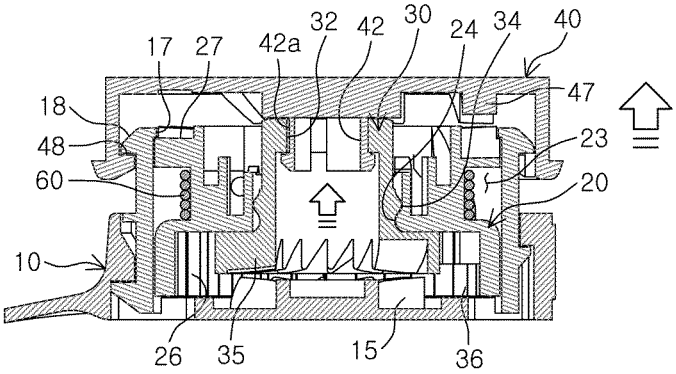

[FIG 8]
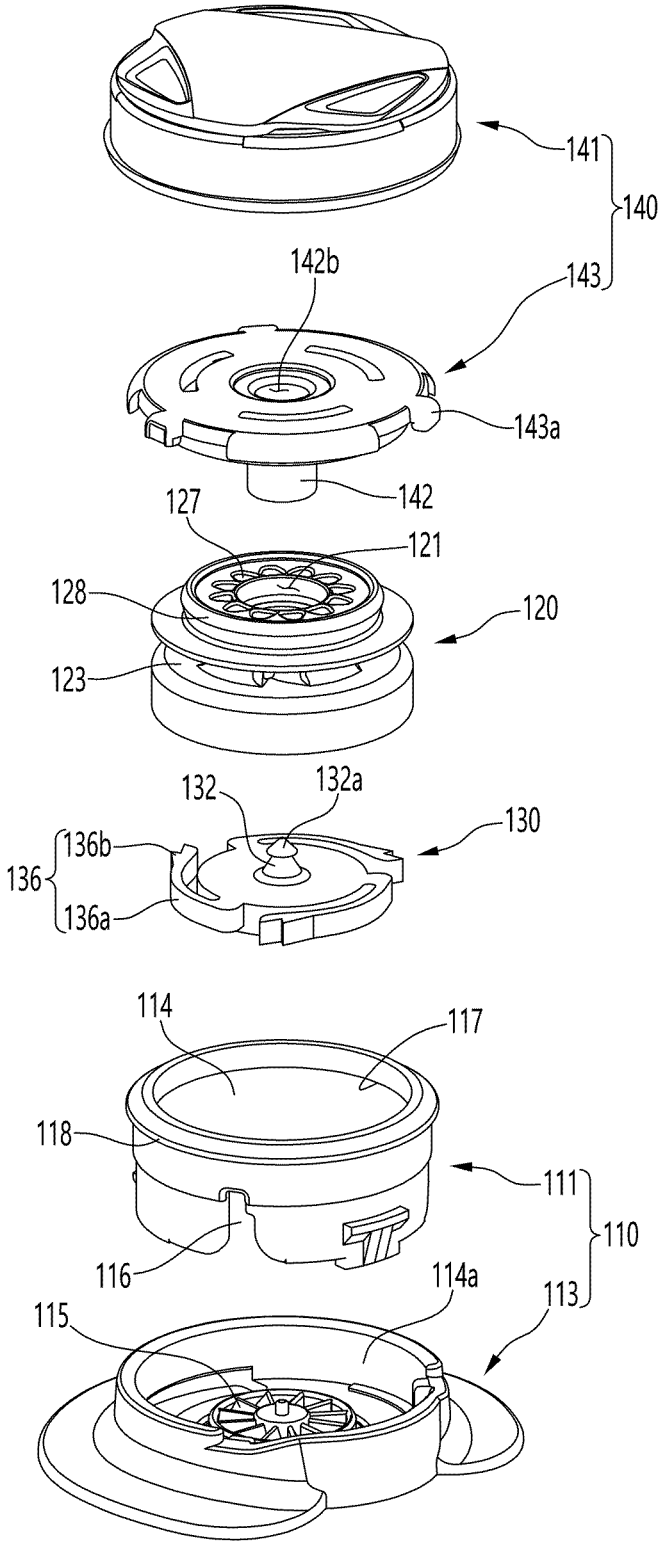

[FIG 9]
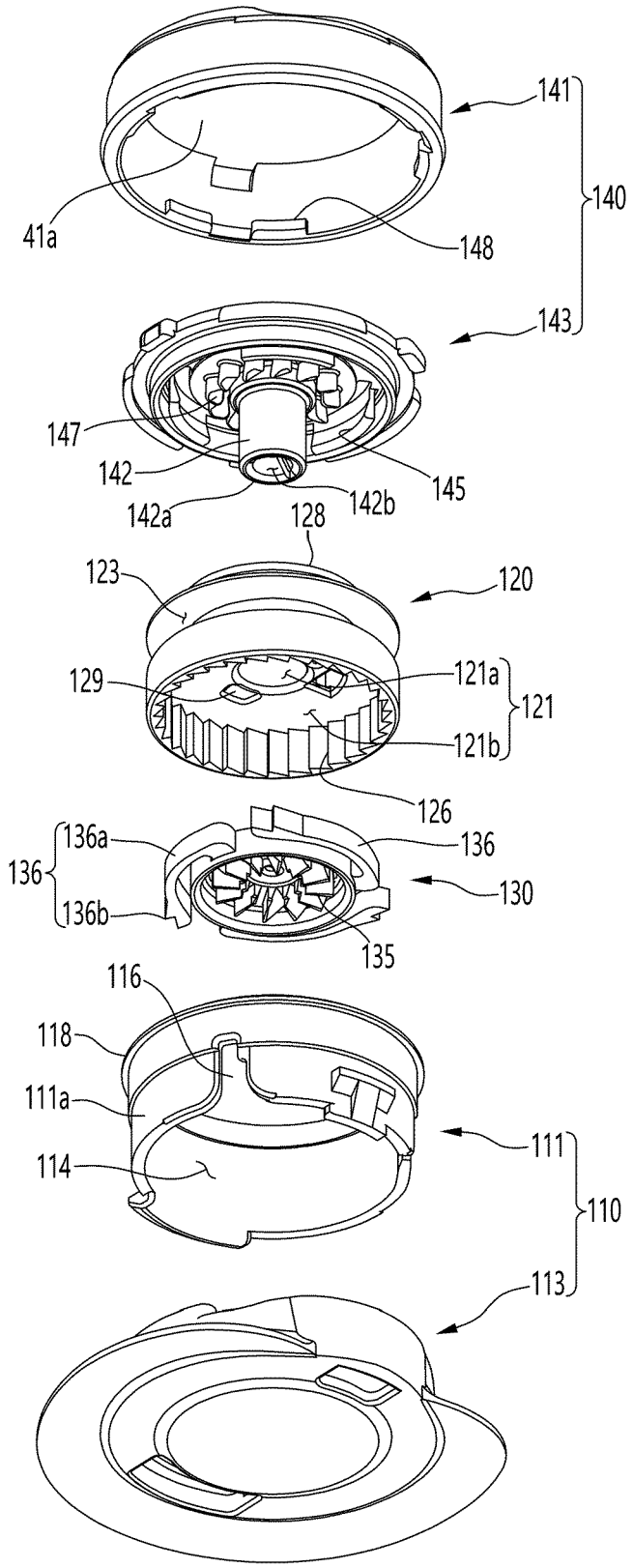

[FIG 10]
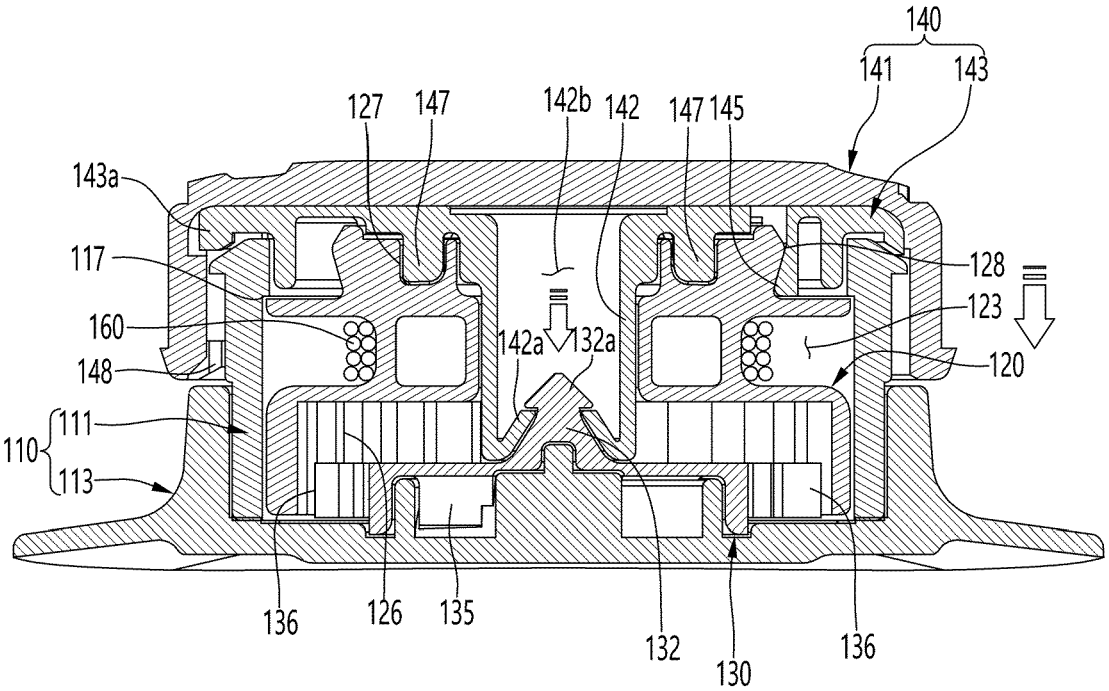
[FIG 11]
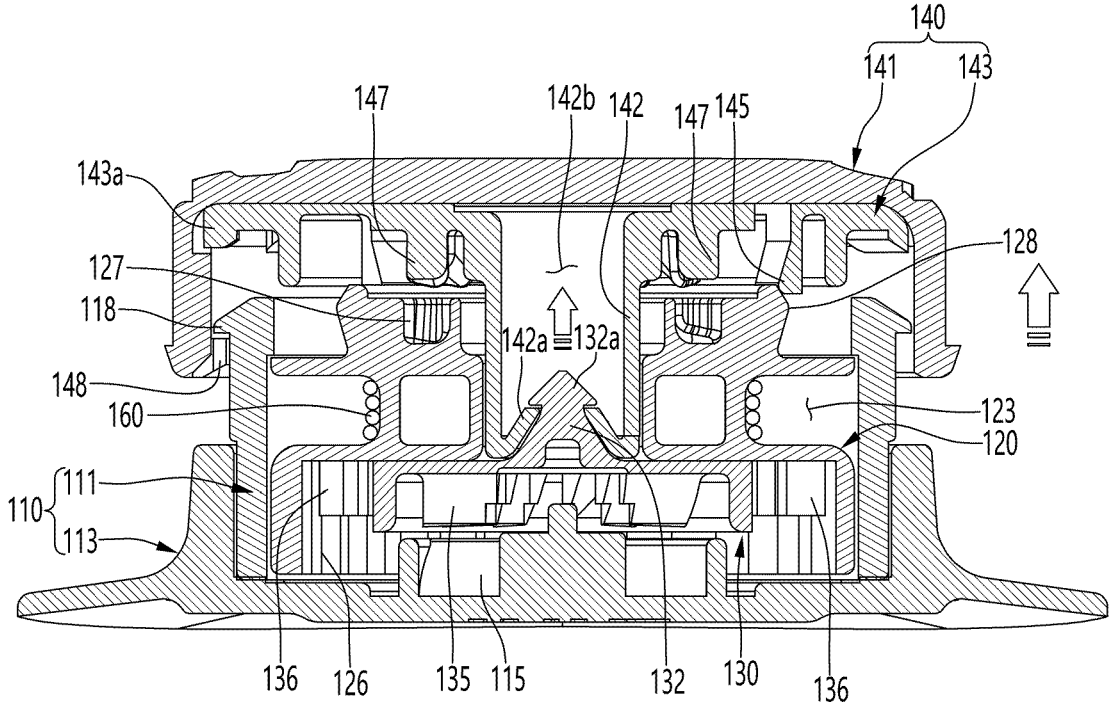

[FIG 12]
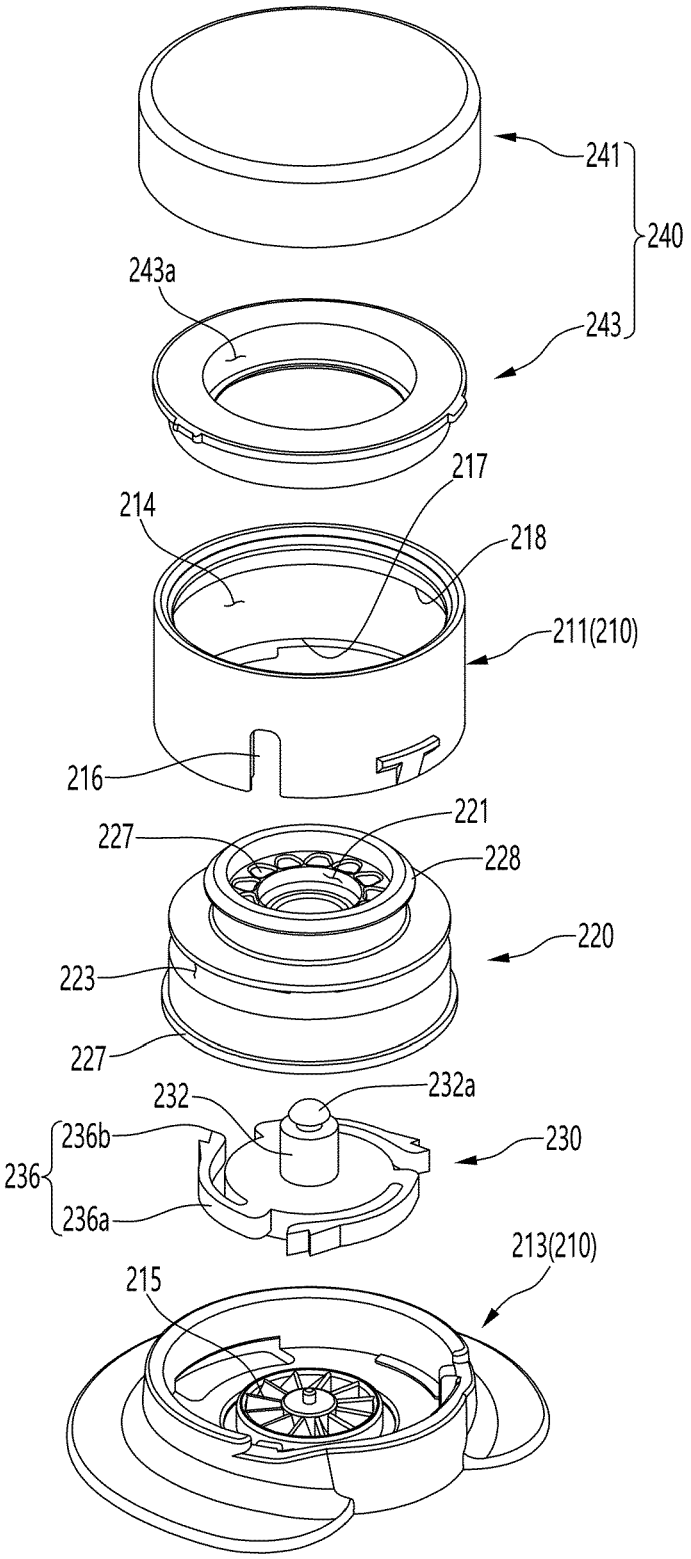

[FIG 13]
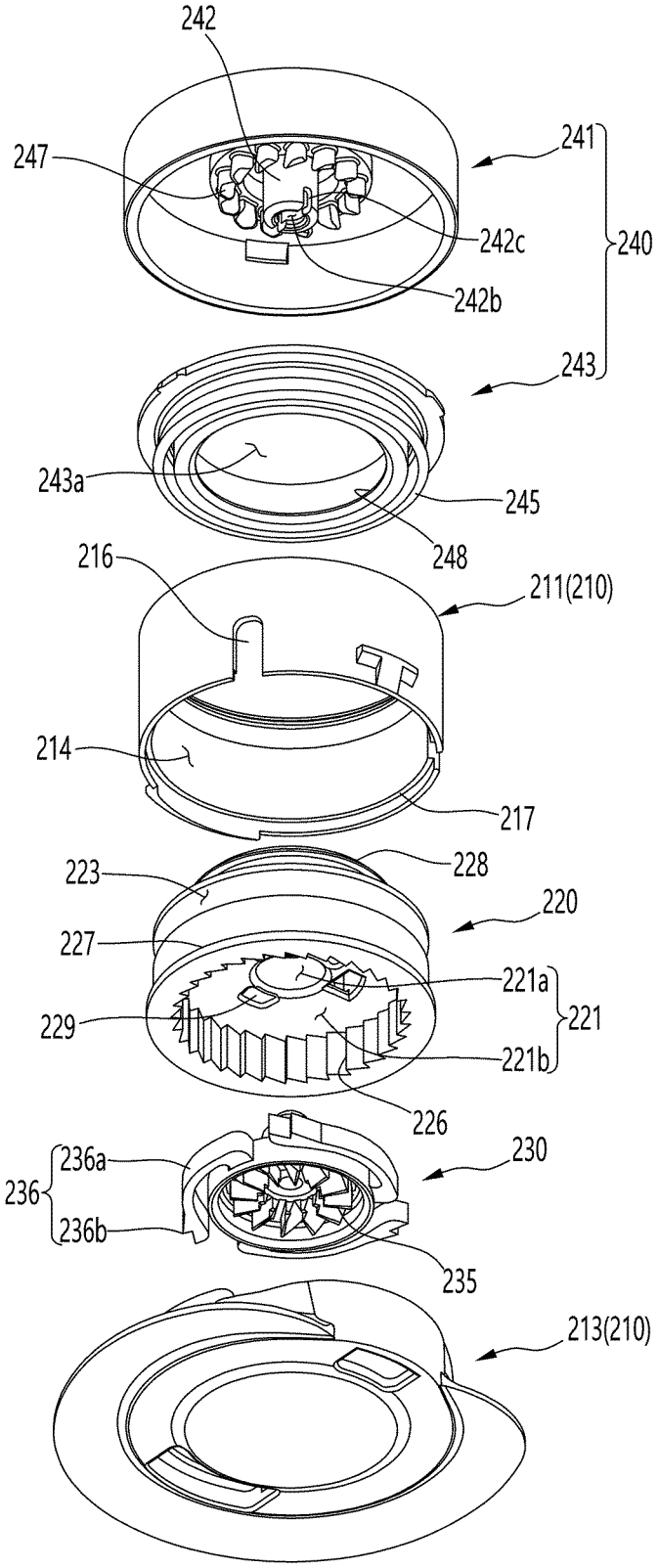

[FIG 14]
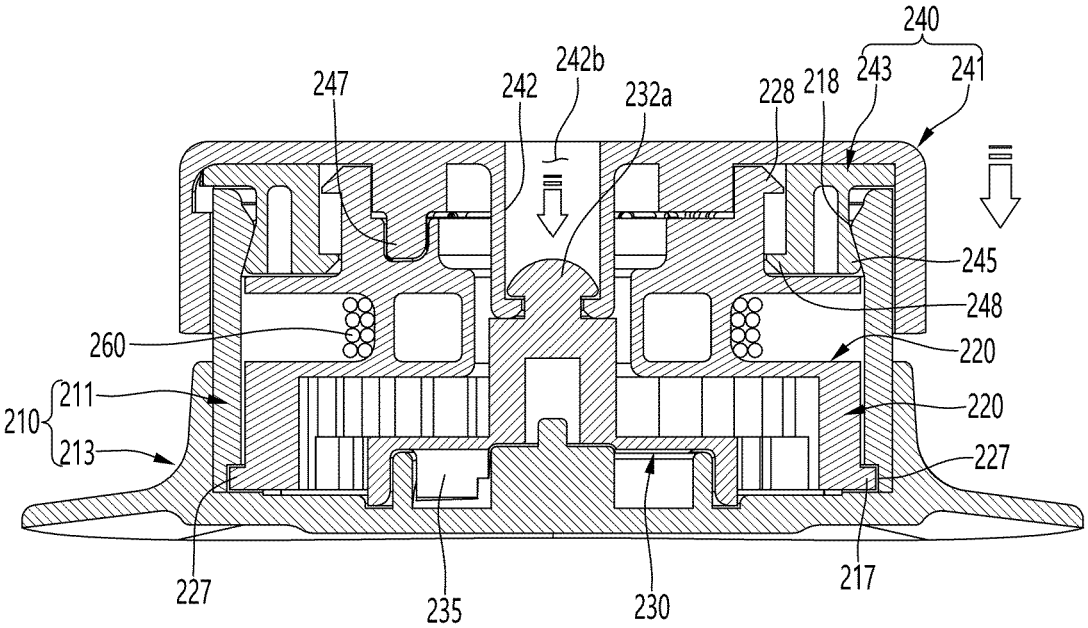
[FIG 15]
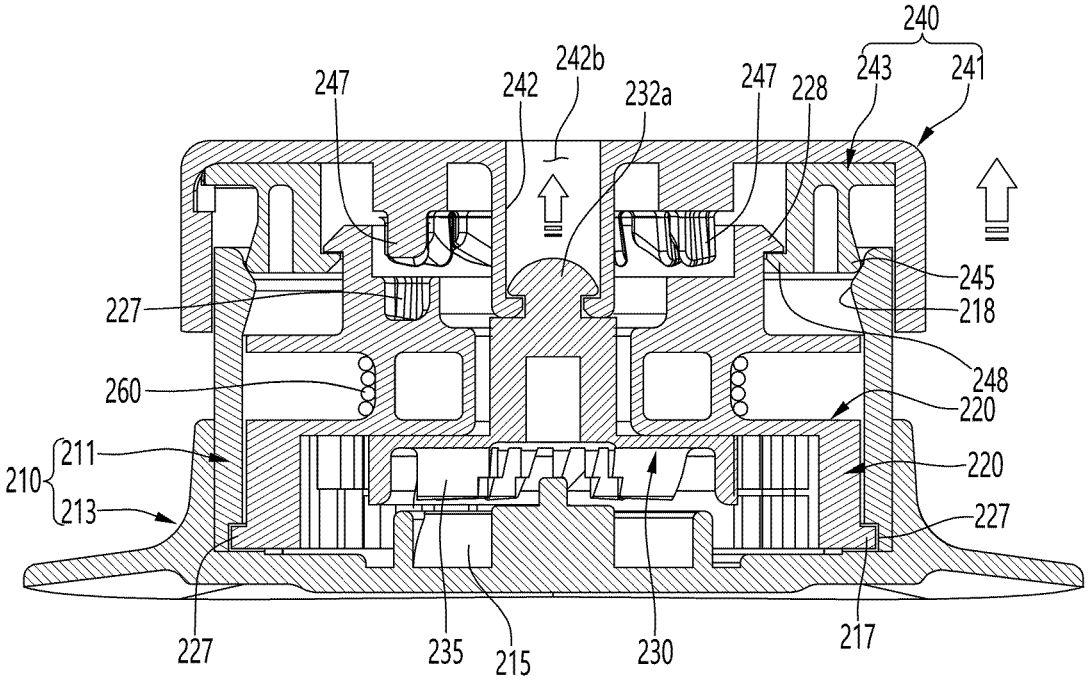

WIRE TIGHTENING DEVICE

TECHNICAL FIELD

The present invention relates to a wire tightening device. More specifically, the present invention relates to a wire tightening device which is installed on a shoe, a bag, a hat, a garment, or the like to tighten or loosen the wire.

BACKGROUND ART

Conventionally, in a case of wearing a shoe, in order to remove the inconvenience of tying or untying a knot of a shoelace, various types of tightening devices by which a user can conveniently tighten or loosen a shoelace have been developed.

Such tightening devices are installed on a bag, a hat, a garment, or the like, as well as shoes, in order to tighten a wire, and are increasing a use range thereof.

FIGS. 1 and 2(*a*) and 2(*b*) illustrate a conventional wire tightening device, disclosed in Korean Patent No. 10-1648815.

Referring to FIGS. 1 and 2(*a*) and 2(*b*), the wire tightening device is assembled by sequentially stacking a housing 1, a winding wheel 2, a gear member 3, a spring 4, and a tightening cap 5 from below.

As illustrated in FIG. 2(*a*), when a user presses the tightening cap 5 and the gear member 3, in a state in which they are lowered by the elasticity of the spring part 4, the gear member 3 and the winding wheel 2 are coupled to each other to be integrally rotated. In this state, the gear member 3 and the winding wheel 2 are restricted in the first directional rotation so as to be rotated only in the direction to wind a wire.

Moreover, when the user raises the tightening cap 5 and the gear member 3, in a state in which they are lifted by the elasticity of the spring part 4, the coupled state of the gear member 3 and the winding wheel 2 is released. In the above state, the winding wheel 2 can be rotated freely, and the wire can be released freely.

However, the conventional wire tightening device has a disadvantage in that the manufacturing process is complicated since the number of assembled components, such as the spring 4, and the assembly is complicated.

Furthermore, since the winding wheel 2 for winding the wire is positioned in the lowermost layer inside the housing 1, the wire is introduced through the bottom of the housing 1. So, the conventional wire tightening device has another disadvantage in that the wire continuously interferes with the surface of a product, such as the shoe, on which the wire tightening device is installed.

DISCLOSURE

Technical Problem

It is an object of the present invention to provide a wire tightening device which is installed on a shoe or the like to smoothly tighten a wire, reduce the number of components, and facilitate assembly.

It is another object of the present invention to provide a wire tightening device, which does not increase the entire height protruding when being installed on a product, such as a shoe, but raises the position of a part in which the wire is wound inside a housing, thereby preventing the wire entering the housing from being interfered with the surface of the product.

It is still another object of the present invention to provide a wire tightening device which does not need a position maintaining means, which is manufactured separately and is complicated in assembly, like a spring but can smoothly maintain ascending and descending positions.

Technical Solution

According to the present invention, there is provided a wire tightening device including: a housing in which an inner space is formed and locking teeth are formed at a bottom portion thereof; a winding wheel located in the inner space of the housing, and having a through hole vertically formed in the middle thereof, a winding groove which is formed on the outer circumferential surface of the through hole and on which a wire is wound, a first ratchet part mounted on the inner circumferential surface of the through hole and below the winding groove, and coupling teeth formed at the upper portion thereof; a lifting member disposed in the through hole of the winding wheel, and having a second ratchet part disposed at a lower portion thereof and engaged with the first ratchet part to allow rotation in one direction and prevent rotation in the other direction with respect to the winding wheel, and engagement teeth formed at a lower end portion thereof to be caught to the locking teeth; and a tightening cap covering an upper end of the housing, having tightening teeth coupled with the coupling teeth when lowering to rotate the winding wheel in the winding direction of the wire, and coupled with the lifting member to perform a lifting motion together with the lifting member.

Moreover, in an embodiment of the present invention, the lifting member and the tightening cap are coupled with each other in a state in which a locking groove and a locking jaw are caught to each other, so that they are lifted together while being locked to each other in a vertical direction, but allow relative rotation in a rotational direction.

Furthermore, in another aspect of the present invention, there is provided a wire tightening device comprising: a housing having a side wall surrounding an inner space and locking teeth formed on the bottom; a tightening cap coupled to an upper portion of the housing and being capable of performing a lifting motion; a winding wheel positioned in the inner space and having a central through hole to wind a wire on a winding groove formed on the outer circumferential surface thereof; and a lifting member located in the through hole, coupled with the winding wheel, performing a lifting motion inside the through hole in a state in which the lifting member is coupled with the tightening cap, and being locked to or separated from the locking teeth during the lifting motion, wherein the lifting member is separated from the locking teeth when the tightening cap is lifted to allow the winding wheel to freely rotate in a direction to release the wire, and the lifting member is coupled with the locking teeth when the tightening cap is lowered to allow the winding wheel to rotate only in the winding direction of the wire but block rotation in the opposite direction.

Moreover, in an embodiment of the present invention, the lifting member and the tightening cap are coupled in such a manner that an upper portion of the lifting member and a lower protrusion of the tightening cap are caught to each other, so that they are lifted together while being locked to each other in a vertical direction, but allow relative rotation in a rotational direction.

Furthermore, in another aspect of the present invention, there is provided a wire tightening device including: a housing having a side wall surrounding an inner space and locking teeth formed on the bottom; a winding wheel disposed in the inner space, and having a through hole vertically formed in the middle thereof, a winding groove which is formed on the outer circumferential surface of the through hole and on which a wire is wound, a first ratchet part mounted on the inner circumferential surface of the through hole and below the winding groove, and coupling teeth formed at the upper portion thereof; a lifting member disposed in the through hole of the winding wheel, and having a second ratchet part disposed at a lower portion thereof and engaged with the first ratchet part, and engagement teeth formed at a lower end portion thereof to be caught to the locking teeth; and a tightening cap coupled to the upper portion of the housing to be able to perform a lifting motion, having tightening teeth separated from the coupling teeth when being lifted but coupled with the coupling teeth when lowered so as to rotate the winding wheel in a direction to tighten the wire, and being coupled with the lifting member to perform the lifting motion together with the lifting member by allowing rotation of the lifting member but being restricted in a vertical movement.

Additionally, in an embodiment of the present invention, the first ratchet part and the second ratchet part have an engagement structure in which an inclination direction of ratchet teeth is set in such a manner as to allow the winding wheel to relatively rotate in the winding direction of the wire but to block the winding wheel from relatively rotating in the releasing direction of the wire with respect to the lifting member.

In addition, in an embodiment of the present invention, ratchet blade teeth of the second ratchet part maintain engaged state while vertically sliding along ratchet teeth of the first ratchet part when the lifting member performs the lifting motion.

Moreover, in an embodiment of the present invention, the through hole is divided into an upper through hole and a lower through hole which is larger in diameter than the upper through hole, and the first ratchet part is formed along the circumference of the lower through hole. The first ratchet part includes ratchet teeth formed on the circumference there of to be inclined in one direction, and a plurality of the second ratchet parts are fixed on the circumference of the lifting member in a vortex shape, and include ratchet blades disposed at a free end thereof and having ratchet blade teeth ratchet-coupled with the ratchet teeth of the first ratchet part.

Furthermore, in an embodiment of the present invention, the housing includes a restriction part to restrict lifting of the winding wheel so that the winding wheel maintains its position in the inner space.

Additionally, in an embodiment of the present invention, the housing includes a restriction part to restrict lifting of the winding wheel, and the winding wheel includes an uplifted part uplifted outward from the upper portion of the through hole in a lateral direction. The tightening cap includes a position setting part which goes over the uplifted part by elasticity, and the engagement teeth is separated from the locking teeth at the position that the position setting part is higher than the uplifted part, but the engagement teeth is caught to the locking teeth at the position that the position setting part is lower than the uplifted part.

Moreover, in an embodiment of the present invention, the tightening cap includes an outer cap and an inner cap fixed in the outer cap, and the inner cap has the position setting part.

Furthermore, in an embodiment of the present invention, the housing includes a restriction part to restrict lifting of the winding wheel, and an uplifted part uplifted in a lateral direction is formed on the inner circumferential surface of the upper end portion of the housing. The tightening cap includes a position setting part which goes over the uplifted part by elasticity, and the engagement teeth is separated from the locking teeth at the position that the position setting part is higher than the uplifted part, but the engagement teeth is caught to the locking teeth at the position that the position setting part is lower than the uplifted part.

In addition, in an embodiment of the present invention, the winding wheel includes an upper end hook formed at the upper end portion thereof, and the tightening cap includes a locking hook which is caught by elasticity while going over the upper end hook when being assembled, so that the tightening cap can be lifted up to a range restricted by the upper end hook and can be lifted up to the range that the engagement teeth can be separated from the locking teeth.

Advantageous Effects

As described above, according to the present invention, the lifting member is arranged in the through hole of the winding wheel and performs the lifting motion inside the through hole. Therefore, the wire tightening device can smoothly tighten the wire, and the components can be arranged spatially efficiently.

Moreover, compared with the conventional wire tightening device, the present invention can reduce the number of the overall components, and can be assembled simply.

Furthermore, the winding groove on which the wire is wound is formed at the upper portion of the winding wheel, the first ratchet part is mounted inside the lower portion of the winding wheel, and the second ratchet part of the lifting member is coupled with the first ratchet part inside the lower portion of the winding wheel. Therefore, the wire tightening device according to the present invention can raise the position of the winding groove for winding the wire inside the housing, but the entire height of the wire tightening device is not increased. In such a structure, the wire can go into and out of the housing without any interference with the surface of the product, and the protrusion height of the wire tightening device mounted on the surface of the product, such as a shoe, is the same as the conventional wire tightening device.

Additionally, the winding wheel or the uplifted part of the housing and the position setting part of the tightening cap can set the position by going over each other without using the conventional position maintaining means made of a metallic material, such as a spring, which is complicated in manufacturing and assembly.

In addition, according to the present invention, the lifting member performs the lifting motion in a state in which the first ratchet part of the winding wheel and the second ratchet part of the lifting member maintain the engaged state. Therefore, when the lifting member performs the lifting motion, since the winding wheel and the lifting member are not separated from each other, it does not generate bad engagement due to separation and coupling, and allows a smooth lifting motion.

DESCRIPTION OF DRAWINGS

FIG. 1 is an exploded perspective view illustrating a configuration of a conventional wire tightening device.

FIGS. 2(*a*) and 2(*b*) are cross-sectional views illustrating an operation in a state in which the wire tightening device of FIG. 1 is assembled.

FIG. 3 is a perspective view illustrating an assembled appearance of a wire tightening device according to a first embodiment of the present invention.

FIG. 4 is an exploded perspective view illustrating an upper configuration of the wire tightening device according to the first embodiment of the present invention.

FIG. 5 is an exploded perspective view illustrating a lower configuration of the wire tightening device according to the first embodiment of the present invention.

FIG. 6 is a cross-sectional view illustrating a state in which the wire tightening device according to the first embodiment of the present invention is switched to tighten a wire in an assembled state.

FIG. 7 is a cross-sectional view illustrating a state in which the wire tightening device according to the first embodiment of the present invention is switched to release the wire in an assembled state.

FIG. 8 is an exploded perspective view illustrating an upper configuration of the wire tightening device according to a second embodiment of the present invention.

FIG. 9 is an exploded perspective view illustrating a lower configuration of the wire tightening device according to the second embodiment of the present invention.

FIG. 10 is a cross-sectional view illustrating a state in which the wire tightening device according to the second embodiment of the present invention is switched to tighten a wire in an assembled state.

FIG. 11 is a cross-sectional view illustrating a state in which the wire tightening device according to the second embodiment of the present invention is switched to release the wire in an assembled state.

FIG. 12 is an exploded perspective view illustrating an upper configuration of the wire tightening device according to a third embodiment of the present invention.

FIG. 13 is an exploded perspective view illustrating a lower configuration of the wire tightening device according to the third embodiment of the present invention.

FIG. 14 is a cross-sectional view illustrating a state in which the wire tightening device according to the third embodiment of the present invention is switched to tighten a wire in an assembled state.

FIG. 15 is a cross-sectional view illustrating a state in which the wire tightening device according to the third embodiment of the present invention is switched to release the wire in an assembled state.

MODE FOR INVENTION

Hereinafter, embodiments of the present disclosure will be described in detail with reference to the accompanying drawings.

Referring to FIGS. 3 to 5, a wire tightening device according to a first embodiment of the present invention includes: a housing 10 having a side wall 11*a* surrounding an inner space 14 and locking teeth 15 formed on the bottom; a tightening cap 40 covering an upper portion of the housing 10 and being capable of performing a lifting motion; a winding wheel 20 positioned in the inner space 14 and having a central through hole 21 to wind a wire 60 on a winding groove 23 formed on the outer circumferential surface thereof; and a lifting member 30 located in the through hole 21, coupled with the winding wheel 20, performing a lifting motion inside the through hole 21 in a state in which the lifting member 30 is coupled with the tightening cap 40, and being locked to or separated from the locking teeth 15 during the lifting motion.

The housing 10 includes a side wall 11*a* surrounding the inner space 14 and locking teeth 15 formed on the bottom thereof.

In detail, the housing 10 includes a base part 13 having a hollowed seating groove 14*a* to be attached to a product, such as a shoe, and a cylindrical sidewall part 11 coupled to the seating groove 14*a* of the base part 13 to surround the inner space 14 and form a sidewall 11*a*.

Preferably, the locking teeth 15 are mounted on the bottom surface of the seating groove 14*a* of the base part 13.

A restriction part 17 is formed at an upper end of the housing 10 to prevent the winding wheel 20 from being lifted to maintain its position in the inner space 14. The restriction part 17 is a jaw to which the upper end of the outer circumferential surface of the winding wheel 20 is caught.

In the assembled state, the restriction part 17 protrudes toward the inner space 14 so that the upper end of the winding wheel 20 is caught to the restriction part 17 not to ascend.

In addition, a limitation protrusion 18 protruding outward is formed at an upper end of the housing 10 to prevent the tightening cap 40 from being separated upwards in a state in which the tightening cap 40 is coupled to the housing 10.

In addition, a pair of wire holes 16 are formed so that the wire 60 can go into and out of the inner space 14 in a state in which the cylindrical sidewall part 11 and the base part 13 are coupled to each other.

The cylindrical sidewall part 11 and the base part 13 may be integrated into a single structure.

Meanwhile, the tightening cap 40 is coupled to cover the upper portion of the housing 10 to move up and down, and the user can rotate the tightening cap 40 by the hand.

The tightening cap 40 has a structure covering the upper end of the housing 10 of a circular container shape, and has a limitation jaw 48 formed at a lower end thereof. The limitation jaw 48 is caught by the limitation protrusion 18 of the housing 10 so that the tightening cap 40 is not separated upwards.

Tightening teeth 47 are formed on the bottom surface inside the tightening cap 40 to rotate the winding wheel 20 in a direction in which the wire 60 is wound by being coupled to coupling teeth 27 of the winding wheel 20 while descending.

The tightening teeth 47 are formed in an annular shape along the circumference of the inner surface of the tightening cap 40. When the tightening teeth 47 are engaged with the coupling teeth 27, a rotational force that a user rotates the tightening cap 40 is transmitted to the winding wheel 20, so that the winding wheel 20 can be also rotated in the direction to tighten the wire 60.

When the tightening cap 40 ascends, the tightening teeth 47 are separated from the coupling teeth 27.

Furthermore, the tightening cap 40 may be coupled to the lifting member 30 to move up and down together with the lifting member 30, but may be coupled to the lifting member 30 to allow rotation of the lifting member 30.

The tightening cap 40 has a coupling structure in which a locking groove 42*a* and a locking jaw 32 are engaged with each other to be lifted together in a state in which they are restricted to each other vertically and to allow relative rotation to each other in the rotational direction.

More specifically, the lifting member 30 has the locking jaw 32 formed in an annular shape on an upper portion thereof, and the tightening cap 40 has a lower protrusions 42 mounted on the bottom surface therein. The lower protrusion 42 has the locking groove 42*a* formed on the circumference thereof so that the locking jaw 32 is caught and coupled to the locking groove 42*a*.

FIG. 5 illustrates that the lower protrusion 42 is split into three to be easily coupled to a central hole 38 of the lifting member 30 and the locking grooves 42*a* are respectively formed on the lower protrusions 42.

Accordingly, the tightening cap 40 and the lifting member 30 move up and down in a state in which they are restricted from each other in the vertical direction, but do not restrict each other during the rotation, thereby allowing relative rotation to each other in the rotation direction.

Such a structure allows the tightening cap 40 to rotate without interference of the lifting member 30 in a case in which the winding wheel 20 winds the wire 60 by lowering the tightening cap 40 to rotate the winding wheel 20.

Meanwhile, the winding wheel 20 is positioned in the inner space 14 and having a central through hole 21 to wind a wire 60 on a winding groove 23 formed on the outer circumferential surface thereof.

The winding wheel 20 has the coupling teeth 27 formed on the upper portion of the winding wheel 20 in an annular shape around the through hole 21 to be coupled to the tightening teeth 47 of the tightening cap 40.

The winding groove 23 is formed at the upper portion of the winding wheel 20 in an annular shape along the circumference of the through hole 21, so that the wire 60 going in and out through the pair of wire entrance holes 16 of the housing 10 is wound and stored in the winding groove 23.

The winding groove 23 has a wire fixing groove 29 to which an end of the wire 60 is fixed.

A first ratchet part 26 is mounted at a lower portion of the inner circumferential surface of the through hole 21 of the winding wheel 20.

The through hole 21 is divided into an upper through hole 21*a* having the winding groove 23 formed on the periphery thereof, and a lower through hole 21*b* having a diameter larger than that of the upper through hole 21*a* and having the first ratchet part 26 formed along the circumference thereof.

The first ratchet part 26 of the lower through hole 21*b* includes ratchet teeth formed on the circumference thereof to be inclined in one direction, and a second ratchet part 36 of the lifting member 30 is ratchet-coupled to the first ratchet part 26 to allow rotation only in one direction.

Meanwhile, the lifting member 30 is disposed in the through hole 21, is coupled to the winding wheel 20, and performs a lifting motion inside the through hole 21 in a state in which the lifting member 30 is coupled with the tightening cap 40.

The lifting member 30 includes the second ratchet part 36 which is engaged with the first ratchet part 26 at the lower portion thereof to allow rotation in one direction and blocks rotation in the other direction. The lifting member 30 further includes engagement teeth 35 disposed at a lower end portion thereof and caught to the locking teeth 15 of the housing 10 so that the lifting member 30 is locked to or separated from the locking teeth 15.

An inclination direction of ratchet teeth is set in such a manner that the engagement structure between the first ratchet part 26 and the second ratchet part 36 allows the winding wheel 20 to relatively rotate with respect to the lifting member 30 in the direction that the wire 60 is wound but blocks the winding wheel 20 from relatively rotating in the direction that the wire 60 is released.

The second ratchet part 36 has a plurality of ratchet blades 36*a* fixed to the circumference of the lifting member 30 in a vortex shape, and ratchet blade teeth 36*b* respectively disposed at free ends of the ratchet blades 36*a* to be engaged and ratchet-coupled with ratchet teeth of the first ratchet part 26.

Accordingly, in a case in which the tightening cap 40 rotates the winding wheel 20 in the direction to wind the wire 60 in a state in which the lifting member 30 is moved downward and is caught to the locking teeth 15 of the housing 10, the winding wheel 20 rotates with respect to the lifting member 30 so that the ratchet teeth 36*a* of the first ratchet part 26 elastically deform the ratchet blades 36*a* of the second ratchet part 36 and rotate beyond the ratchet blade teeth 36*b*.

In a case in which the winding wheel 20 tries to rotate in the opposite direction with respect to the lifting member 30 in a state in which the lifting member 30 is caught to the locking teeth 15, the ratchet teeth of the first ratchet part 26 are caught to the ratchet blade teeth 36*b* of the second ratchet part 26 to prevent the rotation of the winding wheel 20.

Since each ratchet tooth of the first ratchet part 26 is formed vertically long as much as the height of the lower through hole 21*b* , when the ratchet teeth of the second ratchet part 36 vertically slide along the ratchet teeth of the first ratchet part 26 to keep the caught state during the lifting motion of the lifting member 30.

Accordingly, since the first ratchet part 26 and the second ratchet part 36 are not separated from each other during the lifting motion of the lifting member 30, it does not cause a problem of engagement failure and facilitates a smooth lifting motion.

The lifting member 30 includes an uplifted part 34 formed along the outer circumferential surface thereof in an annular shape, and the winding wheel includes a position setting part 24 formed on the inner circumferential surface thereof. During the lifting motion of the lifting member 30, the uplifted part 34 goes over the position setting part 24 by self-elastic deformation while moving up and down, so that the uplifted part 34 can maintain its position at the upper side and the lower side of the position setting part 24.

Therefore, the tightening cap 40 coupled to the lifting member 30 can maintain the lifted state and the lowered state.

Hereinafter, An operating process of the wire tightening device according to the first embodiment of the present invention will be described in more detail.

First, in order to wind and tighten the wire 60, as illustrated in FIG. 6, the user presses the tightening cap 40 and rotates the tightening cap 40.

Referring to FIG. 6, when the tightening cap 40 is lowered, the lifting member 30 restricted in the vertical direction is lowered together with the tightening cap 40 so that the engagement teeth 35 of the lifting member 30 are coupled to the locking teeth 15 of the housing 10. Accordingly, the locking teeth 15 block the lifting member 30 from rotating in the rotational direction, especially, in the direction that the wind 60 is wound.

Moreover, as the tightening cap 40 is lowered, the tightening teeth 47 of the tightening cap 40 is engaged and coupled with the coupling teeth 27 of the winding wheel 20.

In this state, when the user rotates the tightening cap 40 in the winding direction of the wire 60, the tightening cap 40 forcibly rotates the winding wheel 20 by the coupling of the tightening teeth 47 and the coupling teeth 27, and winds and tightens the wire 60 onto the winding groove 23.

In this instance, the engagement structure of the first ratchet part 26 of the winding wheel 20 and the second ratchet part 36 of the lifting member 30 allows the winding wheel 20 to rotate relative to the lifting member 30 in the winding direction of the wire 60. That is, with respect to the lifting member 30 that is caught and stopped by the locking part 15 of the housing 10, the first ratchet part 26 of the winding wheel 20 may goes over the ratchet blades 36*a* while elastically deforming the ratchet blades 36*a* of the second ratchet part 36 of the lifting member 30, so that the winding wheel 20 can rotate.

In such a state, in a case in which the tightening cap 40 tries to rotate the winding wheel 20 in the releasable direction of the wire 60 or the winding wheel 20 tries to rotate in the releasable direction of the wire 60 by an external force to pull the wire 60, with respect to the lifting member 30 that is caught and stopped by the locking part 15 of the housing 10, the first ratchet part 26 of the winding wheel 20 is caught to the second ratchet part 36 to be blocked in rotation and the wire 60 cannot be released.

Therefore, in a case in which the tightening cap 40 and the lifting member 30 are lowered, the winding wheel 20 is rotated in the winding direction of the wire 60.

Meanwhile, in order to release the wire 60, the user holds and raises the tightening cap 40.

Referring to FIG. 7, when the tightening cap 40 is lifted, the engagement teeth 35 of the lifting member 30 are separated from the locking teeth 15 of the housing 10 to allow the winding wheel 20 to freely rotate in the releasing direction of the wire 60.

That is, the lifting member 30 is restricted to the tightening cap 40 to be lifted in the vertical direction together with the tightening cap 40, so that the lifting member 30 is separated from the locking teeth 15 of the housing 10 but the winding wheel 20 freely rotates without restriction. In this instance, the tightening cap 40 may rotate together with the winding wheel 20.

Accordingly, in a case in which the wire 60 is pulled outwards by an external force, the wire 60 can be freely unwound from the winding wheel 20.

Next, a wire tightening device according to a second embodiment of the present invention will be described.

Referring to FIGS. 8 to 11, the wire tightening device according to the second embodiment of the present invention includes: a housing 110 in which an inner space 114 is formed and locking teeth 115 are formed at a bottom portion thereof; a winding wheel 120 located in the inner space 114 of the housing 110, and having a through hole 121 vertically formed in the middle thereof, a winding groove 123 which is formed on the outer circumferential surface of the through hole 121 and on which a wire 160 is wound, a first ratchet part 126 mounted on the inner circumferential surface of the through hole 121 and below the winding groove 124, coupling teeth 127 formed at the upper portion thereof; a lifting member 130 disposed in the through hole 121 of the winding wheel 120 and having a second ratchet part 136 disposed at a lower portion thereof to be engaged with the first ratchet part 126 to allow the winding wheel 120 to rotate in a first direction and to prevent the winding wheel 120 from rotating in a second direction and engagement teeth 135 formed at a lower end portion thereof to be caught to the locking teeth 115; and a tightening cap 140 disposed to cover an upper end of the housing 110, having tightening teeth 147 coupled with the coupling teeth 127 when lowering to rotate the winding wheel 120 in the winding direction of the wire 160, and coupled with the lifting member 130 to perform a lifting motion together with the lifting member 130.

The housing 110 includes a side wall 111*a* surrounding the inner space 114 and the locking teeth 115 formed at the lower portion thereof.

The tightening cap 140 is divided into an outer cap 141 that the user holds with the hand, and an inner cap 143 fixed to the inside of the outer cap 141.

Of course, the outer cap 141 and the inner cap 143 may be manufactured as one integrated component, but they are divided such that the outer cap 141 that the user holds with the hand and the inner cap 143 requiring elastic deformation and engagement are manufactured of different materials to be suitable for their own characteristics.

In the tightening cap 140, the tightening teeth 147 are formed on the bottom surface of the inner cap 143 to be coupled with the coupling teeth 127 of the winding wheel 120 when lowering, thereby rotating the winding wheel 120 in the winding direction of the wire 160.

The coupling teeth 127 are formed on the upper portion of the winding wheel 120 in an annular shape around the through hole 121 to be coupled with the tightening teeth 147 of the tightening cap 140.

The winding wheel 120 includes an uplifted part 128 lifted from the outside of the upper portion of the through hole 121 in a lateral direction.

The uplifted part 128 is integrally formed at the upper end part of the winding wheel 120. The uplifted part 128, which is lifted laterally outward, is formed in an annular shape.

In addition, the inner cap 143 of the tightening cap 140 has a position setting part 145 protruding downwards going over the uplifted part 120 by elasticity, and a plurality of position setting parts 145 are arranged along the annular trajectory of the uplifted part 128.

The configuration of the annular uplifted part 128 and the plurality of position setting parts 145 may be replaced with a configuration of a plurality of uplifted parts 128 arranged along the annular trajectory and an annular position setting part 145. In the above case, the plurality of uplifted parts 128 and the annular position setting part 145 also can go over each other by self-elastic deformation.

Accordingly, the tightening cap 140 coupled with the lifting member 130 can maintain its lifted state and lowered state as it is without external force.

In a case in which the position setting unit 145 of the tightening cap 140 is higher than the uplifted part 128, the lifting member is also in a lifted state so that the engagement teeth 135 are separated from the locking teeth 115. In a case in which the position setting unit 145 of the tightening cap 140 is lower than the uplifted part 128, the lifting member is also in a lowered state so that the engagement teeth 135 interlock with the locking teeth 115.

Since the uplifted part 128 is formed outside the through hole 121 at the upper portion of the winding wheel 120, the uplifted part 128 is formed around the through hole 121 to be larger in diameter than the through hole 121 of the winding wheel 120, so that the contact area and range of the uplifted part 128 and the position setting part 145 may be formed to be wider along the larger annular trajectory than the through hole 121.

Even though the tightening cap 140, the winding wheel 120, and other components are made of a material having a small elastic deformation, it is possible to easily manufacture the uplifted part 128 and the position setting part 145 to maintain a predetermined force to go over each other and to operate smoothly.

If the uplifted part 128 and the position setting part 145 are formed in a narrow area like the through hole 121 of the winding wheel 120, in order not to be operated by very small power, a material having sufficient elasticity and deformation must be selected, and a worker must pay a considerable attention to the shape of the uplifted part 128 when designing the present invention.

Furthermore, when the tightening cap 140 is assembled to cover the upper end of the housing, the uplifted part 128 of the winding wheel 120 and the position setting part 145 of the tightening cap 140 come into contact with each other. In the contact state, the lifting motion is performed. Therefore, the position of the tightening cap 140 with respect to the winding wheel 120 may always be accurately maintained, and the separation and engagement of the tightening teeth 147 and the coupling teeth 127 may always be accurately performed.

Hereinafter, an operational process of the wire tightening device according to the second embodiment of the present invention will be described.

First, in order to wind and tighten the wire 160, as illustrated in FIG. 10, the user presses the tightening cap 140 and rotates the tightening cap 140.

When the tightening cap 140 is lowered, the lifting member 130 restricted in the vertical direction is lowered together with the tightening cap 140 so that the engagement teeth 135 of the lifting member 130 are coupled to the locking teeth 115 of the housing 110.

In this instance, the position setting part 145 of the tightening cap 140 goes over the uplifted part 128 by elastic deformation to maintain the position lower than the uplifted part 128, and the lifting member 130 also maintains its lowered state.

As the tightening cap 140 is lowered, the tightening teeth 147 of the tightening cap 140 is engaged and coupled with the coupling teeth 127 of the winding wheel 120.

In this state, when the user rotates the tightening cap 140 in the winding direction of the wire 160, the tightening cap 140 forcibly rotates the winding wheel 120 by the coupling of the tightening teeth 147 and the coupling teeth 127, and winds and tightens the wire 160 onto the winding groove 123.

In this instance, the engagement structure of the first ratchet part 126 of the winding wheel 120 and the second ratchet part 136 of the lifting member 130 allows the winding wheel 120 to rotate relative to the lifting member 130 in the winding direction (first direction) of the wire 160. That is, with respect to the lifting member 130 that is caught and stopped by the locking part 115 of the housing 110, the first ratchet part 126 of the winding wheel 120 may goes over the ratchet blades 136*a* while elastically deforming the ratchet blades 136*a* of the second ratchet part 136 of the lifting member 130, so that the winding wheel 120 can rotate.

Meanwhile, in order to release the wire 160, as illustrated in FIG. 11, the user holds and raises the tightening cap 140.

In this instance, the position setting unit 145 of the tightening cap 140 goes over the uplifted part 128 by elastic deformation to maintain the position higher than the uplifted part 128, and the lifting member 130 also maintains its lifted state.

As the tightening cap 40 is lifted, the engagement teeth 135 of the lifting member 130 are separated from the locking teeth 115 of the housing 110, and the winding wheel 120 can freely rotate in the releasing direction of the wire 160.

Accordingly, in a case in which the wire 160 is pulled outwards by an external force, the wire 160 can be freely released from the winding wheel 120.

Next, a wire tightening device according to a third embodiment of the present invention will be described.

Referring to FIGS. 12 to 15, in comparison with the first and second embodiments, the wire tightening device according to the third embodiment has differences in formation positions of the restricting part 217 and the uplifted part 218, and is different in an upper end hook 228 of the winding wheel 220 and a locking hook 248 of the tightening cap 240 from the first and second embodiments.

In addition, the wire tightening device according to the third embodiment is also different in that an inner cap 243 of the tightening cap 240 is formed in an annular shape having an annular center hole 243*a*, and tightening teeth 247 and a lower protrusion 242 are formed integrally with an outer cap 241 at the bottom surface of the outer cap 241 and are located in the annular center hole 243*a* from the first and second embodiments.

Since a restriction part 217 is to restrict lifting of the winding wheel 220, is formed at the lower end of a housing 210 in the form of an annular jaw. The restriction part 217 covers an annular restriction rim 225 of the winding wheel 220 from above.

Since the restriction part 217 is formed in the form of an annular jaw and covers an annular restriction rim 225 of the winding wheel 220, when the winding wheel 220 rotates, the restriction rim 225 is restricted at the lower portion of the restriction part 217 and the rotation of the winding wheel 220 is allowed.

Meanwhile, an uplifted part 218 is formed in an annular shape on the inner circumferential surface of the upper end portion of the housing 10 and is lifted laterally inward.

A position setting part 245 going over an uplifted part 218 by the elasticity is formed to protrude downward from the inner cap 243 of the tightening cap 240.

It is preferable that a plurality of position setting units 245 which are split to be divided are arranged in an annular trajectory because elastic deformation is easily generated and the action going over the uplifted part 218 can be more smoothly performed.

In the same manner as the second embodiment, the uplifted part 218 is formed on the outer side of the through hole 221 above the winding wheel 220, and is formed to have a diameter larger than that of a through hole 221 of the winding wheel 220, so that the contact area and range of the uplifted part 218 and the position setting part 245 are wider than those formed on the through hole 221.

Meanwhile, in this embodiment, the upper end hook 228 is formed at the upper end portion of the winding wheel 220, and the locking hook 248 is formed on the tightening cap 240 to be caught by elasticity while going over the upper end hook 228.

More preferably, any one of the upper end hook 228 and the locking hook 248 is formed in an annular shape, and the other one is split so as to be arranged in an annular trajectory.

In this instance, the tightening cap 240 is lifted up to a range to limit the upper end hook 228.

In this instance, the tightening cap 240 is lifted up to the limit range of the upper end part 228. The tightening cap 240 is lifted up to the range that the engagement teeth 235 are completely separated from the locking teeth 215.

The above configuration substitutes the configuration of a restriction protrusion 118 and a restriction jaw 148 of the second embodiment.

The above configuration can be usefully applied in a case in which the outer cap 241, which the user holds with the hand, and the housing for protecting the internal components are difficult to be manufactured of elastic materials, since the locking hook 248 is formed on the inner cap 243 of the tightening cap 240 and the upper end hook 228 is formed integrally with the winding wheel 220.

INDUSTRIAL APPLICABILITY

The present invention can be installed on a shoe, a bag, a hat, a garment, or the like to tighten or loosen the wire (string).

The invention claimed is:

1. A wire tightening device comprising:

a housing in which an inner space is formed and locking teeth are formed at a bottom portion thereof;

a winding wheel located in the inner space of the housing, and having a through hole vertically formed in the middle thereof, a winding groove which is formed on the outer circumferential surface of the through hole and on which a wire is wound, a first ratchet part mounted on the inner circumferential surface of the through hole and below the winding groove, and coupling teeth formed at the upper portion thereof;

a lifting member disposed in the through hole of the winding wheel, and having a second ratchet part disposed at a lower portion thereof and engaged with the first ratchet part to allow rotation in one direction and prevent rotation in the other direction with respect to the winding wheel, and engagement teeth formed at a lower end portion thereof to be caught to the locking teeth; and a tightening cap coupled to the upper portion of the housing in a liftable manner, having tightening teeth coupled with the coupling teeth when lowering to rotate the winding wheel in the winding direction of the wire, and coupled with the lifting member to perform a lifting motion together with the lifting member, wherein the through hole is divided into an upper through hole and a lower through hole which is larger in diameter than the upper through hole, and the first ratchet part is formed along the circumference of the lower through hole, wherein the first ratchet part includes ratchet teeth formed on the circumference there of to be inclined in one direction, and wherein a plurality of the second ratchet parts are fixed on the circumference of the lifting member in a vortex shape, and include ratchet blades disposed at a free end thereof and having ratchet blade teeth ratchet-coupled with the ratchet teeth of the first ratchet part.

2. The wire tightening device according to claim 1, wherein the lifting member and the tightening cap are coupled with each other in a state in which a locking groove and a locking jaw are coupled to each other by a coupling structure that they are caught to each other, so that they are lifted together while being locked to each other in a vertical direction, but allow relative rotation in a rotational direction.

3. The wire tightening device according to claim 1, wherein ratchet blade teeth of the second ratchet part maintain engaged state while vertically sliding along ratchet teeth of the first ratchet part when the lifting member performs the lifting motion.

4. The wire tightening device according to claim 1, wherein the housing includes a restriction part to restrict lifting of the winding wheel so that the winding wheel maintains its position in the inner space.

5. A wire tightening device comprising:

a housing having a side wall surrounding an inner space and locking teeth formed on the bottom;

a winding wheel disposed in the inner space, and having a through hole vertically formed in the middle thereof, a winding groove which is formed on the outer circumferential surface of the through hole and on which a wire is wound, a first ratchet part mounted on the inner circumferential surface of the through hole and below the winding groove, and coupling teeth formed at the upper portion thereof;

a lifting member disposed in the through hole of the winding wheel, and having a second ratchet part disposed at a lower portion thereof and engaged with the first ratchet part, and engagement teeth formed at a lower end portion thereof to be caught to the locking teeth; and a tightening cap coupled to the upper portion of the housing to be able to perform a lifting motion, having tightening teeth separated from the coupling teeth when being lifted but coupled with the coupling teeth when lowered so as to rotate the winding wheel in a direction to tighten the wire, and being coupled with the lifting member to perform the lifting motion together with the lifting member by allowing rotation of the lifting member but being restricted in a vertical movement, wherein the through hole is divided into an upper through hole and a lower through hole which is larger in diameter than the upper through hole, and the first ratchet part is formed along the circumference of the lower through hole, wherein the first ratchet part includes ratchet teeth formed on the circumference there of to be inclined in one direction, and wherein a plurality of the second ratchet parts are fixed on the circumference of the lifting member in a vortex shape, and include ratchet blades disposed at a free end thereof and having ratchet blade teeth ratchet-coupled with the ratchet teeth of the first ratchet part.

6. The wire tightening device according to claim 5, wherein the first ratchet part and the second ratchet part have an engagement structure in which an inclination direction of ratchet teeth is set in such a manner as to allow the winding wheel to relatively rotate in the winding direction of the wire but to block the winding wheel from relatively rotating in the releasing direction of the wire with respect to the lifting member.

7. The wire tightening device according to claim 5, wherein ratchet blade teeth of the second ratchet part maintain engaged state while vertically sliding along ratchet teeth of the first ratchet part when the lifting member performs the lifting motion.

8. The wire tightening device according claim 5, wherein the housing includes a restriction part to restrict lifting of the winding wheel so that the winding wheel maintains its position in the inner space.

* * * * *